United States Patent [19]

Turk et al.

[11] 4,014,476

[45] Mar. 29, 1977

[54] APPARATUS FOR WINDING CONTINUOUS THREADS OR YARNS

[75] Inventors: Herbert Turk, Remscheid; Herbert Schiminski, Huckeswagen, both of Germany

[73] Assignee: Barmag Barmer Maschinenfabrik Aktiengesellschaft, Wuppertal, Germany

[22] Filed: Nov. 19, 1975

[21] Appl. No.: 633,455

[30] Foreign Application Priority Data

Nov. 21, 1974 Germany ..... 2455116

[52] U.S. Cl. ..... 242/19; 242/18 A; 242/18 DD; 242/41; 242/125.1

[51] Int. Cl.[2] ..... B65H 75/32; B65H 67/04

[58] Field of Search ..... 242/19, 18 R, 18 DD, 242/18 PW, 18 A, 25 R, 25 A, 41, 125.1

[56] References Cited

UNITED STATES PATENTS

| | | | |
|---|---|---|---|
| 3,030,039 | 4/1962 | Roberts | 242/18 PW |
| 3,149,795 | 9/1964 | Rhein, Jr. | 242/18 A |
| 3,310,247 | 3/1967 | Emery | 242/18 A |
| 3,488,010 | 1/1970 | Parry | 242/18 PW |
| 3,767,129 | 10/1973 | Sobel | 242/18 PW X |
| 3,814,339 | 6/1974 | Hudson | 242/18 PW |
| 3,815,836 | 6/1974 | Munnekehoff et al. | 242/46.4 |
| 3,880,371 | 4/1975 | Landenberger et al. | 242/18 PW X |
| 3,913,852 | 10/1975 | Lenk et al. | 242/18 A |

*Primary Examiner*—Stanley N. Gilreath
*Attorney, Agent, or Firm*—Johnston, Keil, Thompson & Shurtleff

[57] ABSTRACT

An apparatus for the winding of continuous threads or yarns in which at least one chuck is provided, having a spool stop mounted thereon, on which at least one removable spool sleeve may be slidably positioned for thread take-up. The end surface of the spool sleeve has a lug formed on it which provides a defined spacing between the sleeve and stop when the sleeve is slid over the chuck. A means for cutting the continuous thread is located on the chuck in the space formed between the sleeve and stop. In the cutting operation, the thread is always presented to the cutting means at a constant, repeatable angle due to the action of the spool lug and a thread-catching notch formed on the end surface of the sleeve in a preferred embodiment of the invention. Furthermore, multiple spools may be mounted on the chuck in accordance with the teachings of the present invention in order to provide for increased efficiency of the winding operation.

8 Claims, 4 Drawing Figures

APPARATUS FOR WINDING CONTINUOUS THREADS OR YARNS

INTRODUCTION

The present invention relates generally to an apparatus for winding continuous linear structures, and more particularly to an apparatus for winding freshly spun synthetic threads or yarns of linear, high-molecular weight polymers.

BACKGROUND OF THE INVENTION

In the winding of continuous threads or yarns, it is a general practice to sever the thread with a cutting means mounted on the chuck of the apparatus after completion of the transfer of the thread from the finished spool or bobbin to an empty spool. See for example, German Pat. DT-PS 974,536 or German laid-open Pat. application DT-OS 2,248,875. Such thread cutting means are used when, for example, physical breaking of the thread is not desirable because of possible damage to the thread build-up on the bobbins or when such breaking is not practically possible due to the excessively high forces necessary as in the case of technical denier carpet yarns, cord threads and the like. On the other hand, in the winding of threads having a low denier, such as textile denier, such thread cutting means are generally dispersed with.

Furthermore, apparatus for winding two or more shorter spools on a chuck, rather than one longer spool, are also known in the art. See Pat. No. 10,134 of the German Democratic Republic, German published patent application DT-AS 1,660,311, or German laid-open patent application DT-OS 2,056,146. Such multiple spool devices have heretofore been essentially used only for the winding of textile denier threads.

BRIEF DESCRIPTION OF THE INVENTION

The present invention has been designed for the winding of continuous threads or yarns having a higher denier, especially of a technical denier, onto multiple spools which are removable from the chuck of the apparatus. The present invention overcomes the practical problems associated with providing a chuck that may be utilized with multiple spools and which has several thread-severing zones that do not interfer with the movement of the spools as they are successively slipped on to and off of the chuck during the bobbin changing operation. It has been found that in order to meet these requirements, the thread-severing zones should preferably be mounted on the chuck apparatus, below the outer surface of the spools. If such thread-severing zones are made a part of the removable spool sleeves, it has been found that such an arrangement undesirably increases the difficulty and efficiency of automatic bobbin changing operations.

A further important feature offered by the present invention is the providing of defined spacings between the individual spool sleeves, so that after completion of the thread transfer operation from the finished bobbins to the empty spools, the various threads will be easily and positively guided into the thread-severing zones located between the spools.

The present invention accomplishes these features by providing a combination of elements which combine to give a highly effective thread winding apparatus which is particularly useful and efficient in automatic winding applications. According to the present invention, there is generally provided at least one chuck having a spool stop mounted thereon and a removable spool sleeve which may be slidably positioned on the chuck for thread take-up. The end surface of the spool sleeve has a lug formed on it which provides a defined spacing between the sleeve and the stop. A means for cutting the continuous thread is located on the chuck in the space formed between the sleeve and stop.

The design of the winding apparatus allows for the automatic guidance of the thread into the thread-severing zone between the spool and stop under constant, reproducable conditions. In addition, since the above-described lug, preferably in conjunction with a thread-catching notch formed on the end surface of the sleeve, always presents the thread to the cutting means at a constant, repeatable angle, equal dimensional relations of the cut threads may be achieved from bobbin change to bobbin change. In addition, with the present invention multiple spools may be utilized on a single chuck with separate thread-severing zones being provided between the spools in the same manner as has been described for between an individual spool and stop.

Winding apparatus constructed in accordance with the present invention may be used to wind either textile or technical threads. In addition, it allows for several spools to be arranged in succession on one chuck, thereby greatly increasing the productivity of the machine without requireing it to manipulate excessively large finished bobbins and spools of great weight. Furthermore, threads of technical denier may be automatically cut with an equally long free thread end being produced between the bobbin and cutting zone.

Since the cutting zones of the present invention may be partially covered by the spool sleeves and located below their inner surface, it is avoided that the thread ends remain sticking at projecting parts of the chuck or winding device, which could lead to disturbances during the bobbin winding operation or during the next bobbin change. In addition, the possibility of accidental injury to the operating personnel is thereby greatly reduced in this manner with the present invention.

DESCRIPTION OF THE PREFERRED EMBODIMENT

Figure 1:
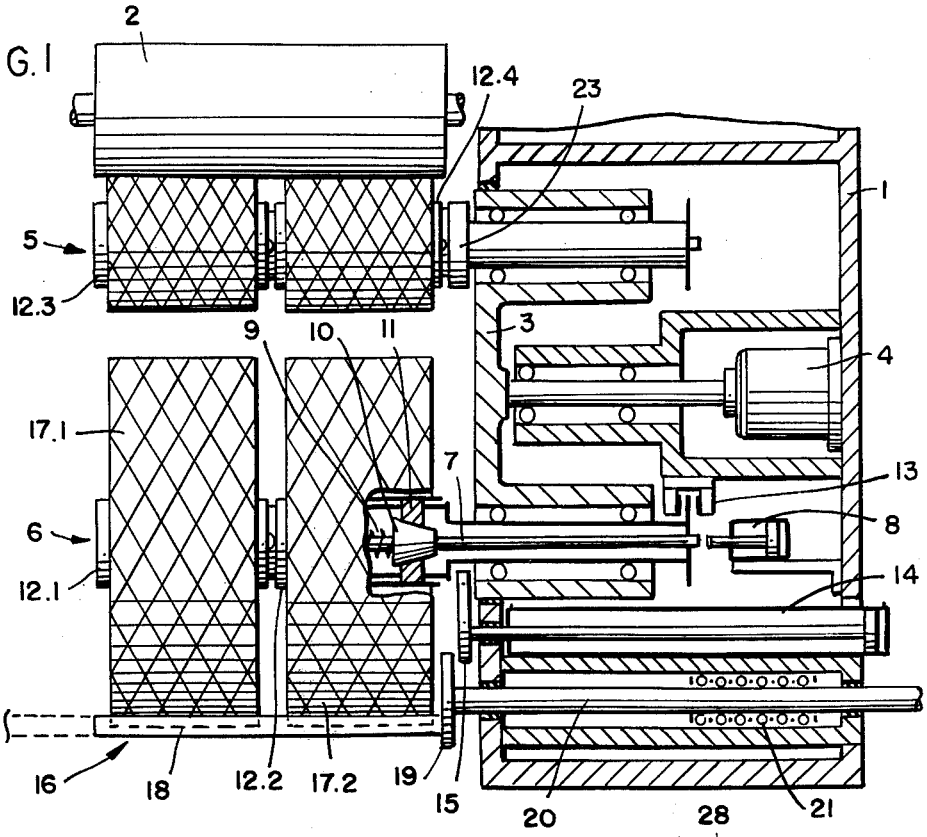
FIG. 1 is a partial, side elevational view of a winding apparatus constructed in accordance with an embodiment of the present invention.

Referring initially to FIG. 1, there is illustrated a winding apparatus 1 constructed in accordance with a preferred embodiment of the present invention. The winding apparatus is designed to be utilized for the winding of continuous threads and yarns such as are used in synthetic fiber spinning installations and the like. The complete operational details for such winding systems are described, for example, in co-pending U.S. Pat. application Ser. No. 534,648, filed Dec. 19, 1974.

The winding apparatus comprises essentially a drive roller 2, which is vertically movable within slide pieces (not shown), and a bobbin revolver 3 having a rotary drive 4 and chucks 5 and 6 connected thereto. In the particular view illustrated, chuck 5 is shown in an operating position and chuck 6 is shown in a rest position prior to removal of finished bobbins 17.1 and 17.2 therefrom.

The chucks are freely turnable on the bobbin revolver and have a release means thereon operable in the rest position against the action of spiral spring 9 for the purpose of bobbin exhange. For this purpose in the preferred embodiment, there acts on the mandrel of the chuck at rest, through pressure rod 7, the piston rod of cylinder-piston unit 8. On pressure rod 7 there are arranged several bevel wheels 10 which are axially spaced in succession. When these wheels are axially displaced through the action of piston unit 8 acting on pressure rod 7, divided rings 11 or other such suitable radial clamping elements are freed from clamping contact with spool sleeves 12.1 and 12.2 slidably inserted on the chucks. In this manner the spool sleeves may be removed from or replaced on the chucks in operation.

However, it is noted that the manner of functioning of the chucks is not an essential element of the invention. There are numerous other equivalent constructions of the chuck that may be utilized with the present invention, such as those disclosed in German laid-open applications DT-OS 2,106,493 and DT-OS 2,202,009 and the like. In the case of the last-mentioned application, it is noted that before the spool may be changed, it must be released by an additional arrangement that causes an additional twisting of the spool sleeve with respect to the chuck. See co-pending U.S. Pat. application Ser. No. 601,795, filed Aug. 4, 1975, now U.S. Pat. No. 3,974,973.

Since the bobbins rotate at a relatively high speed on the bobbin revolver, a brake 13 is provided to stop the rotation of the finished bobbin prior to its removal. In the preferred embodiment, brake 13 is a pneumatically operated disk or jaw brake.

Furthermore, there is represented in the drawing a slide-out device 15 for removal of the finished bobbins which is operated by cylinder-piston unit 14. This slide-out device is described in detail in co-pending U.S. Pat. application Ser. No. 590,119, filed June 25, 1975. It comprises essentially a pressure plate fastened to the piston rod of cylinder-piston unit 14 for causing the spool sleeves to slide away from the bobbin revolver 3 and a receiving device 16 for the finished bobbins 17.1 and 17.2, there being provided in the pressure plate a recess corresponding to the diameter of the chunk. Slide-out device 16 is formed preferably of two rods 18 arranged near the circumference of the finished bobbins 17.1 and 17.2, the rods defining between them a receiving trough for the bobbins. Rods 18 are secured to a plate 19 which is positioned at the head of a guide rod 20. In the removal of the finished bobbins by slide-out device 15, plate 19 is carried along with the guide rod 20 which is centered in bearing 21. In this manner, the thrust out bobbins are automatically deposited in the trough of receiving device 16. After the return stroke of cylinder-piston unit 14 and removal of finished bobbins 17.1 and 17.2 and/or re-equipping of the chunk with an empty spool sleeve, receiving device 16 is slid back into its starting position either automatically or by manual operation by the operating personnel.

In the particular example of the winding apparatus shown in FIG. 1, spool sleeves 12.1 and 12.2 are slid in succession on chuck 6 and spool sleeves 12.3 and 12.4 are slid in succession on chuck 5. Spool sleeves 12.2 and 12.4 are slightly spaced from annular stops 23 of the chunks by means of a spacing defined by the axial length of lug 22 which is mounted on the end surface of the emplaced spool sleeve 12 (See FIG. 2 for a clearer view of thus lug arrangement). Likewise, spool sleeves 12.1 and 12.3 are spaced from the faces of their respective first slipped-on spool sleeves by the spacing defined by the axial length of their lugs 22.

Figure 2:
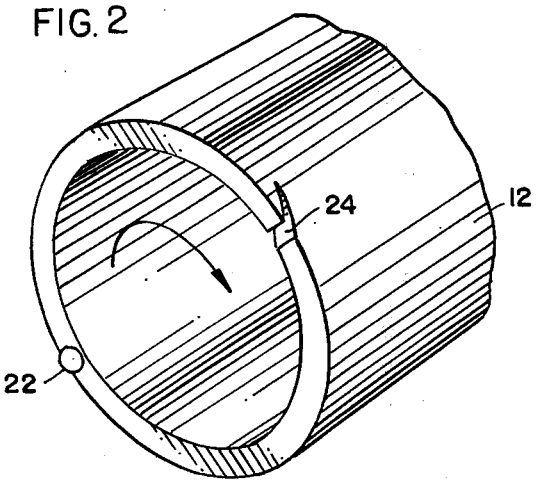
FIG. 2 is a partial perspective view of an element of the apparatus shown in FIG. 1.

FIG. 2 shows spool sleeve 12, corresponding to any of spool sleeves 12.1, 12.2, 12.3 or 12.4 in FIG. 1, in perspective. Spool sleeve 12 has at least one lug 22 formed on its face side with a thread catching notch 24 angularly displaced a distance therefrom. It is desirable that lug 22 be offset with respect to notch 24 by an angle of 15° to 270°, and preferably between 60° and 180°. This angular displacement is selected so that the thread may be severed on a secant formed between the thread catching notch and the lug by one of the cutting elements shown in detail in FIG. 3. Lug 22 which defines the spacing between the spool sleeves projects from the spool face by a distance between 2 mm and 6 mm, and preferably between 2 mm and 4 mm.

Figure 3:
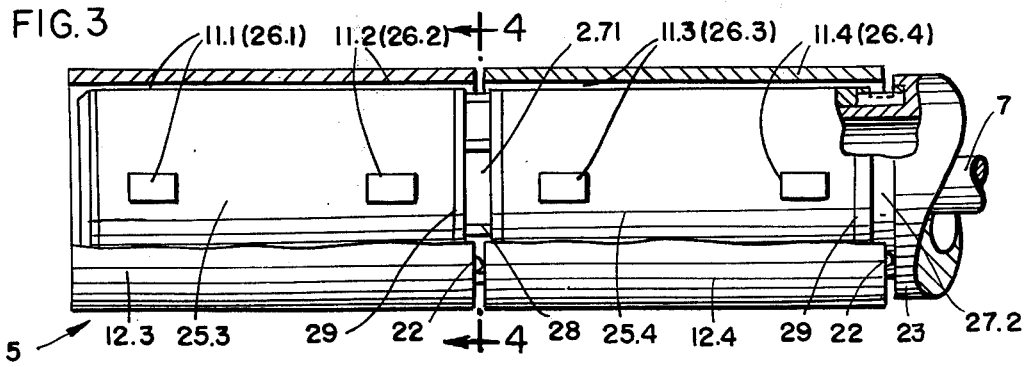
FIG. 3 is a partial side elevational view showing further details of a portion of the apparatus shown in FIG. 1; and, FIG. 4 is an end view in section taken along line IV—IV of FIG. 3.

FIG. 3 illustrates in larger scale a chuck (corresponding to chuck 5 in FIG. 1) having two empty sleeves 12.3 and 12.4 mounted thereon. Also shown are hollow cylindrical cages 25.3 and 25.4 of chuck 5 which have peripherally distributed recesses 26.1, 26.2, and 26.3 and 26.4 formed therein in which the bobbin clamping elements are radially movable. These clamping elements are secured to the divided rings 11.1, 11.2, 11.2 and 11.4 and are restrained against dropping out when the sleeve is drawn off of the chuck.

Figure 4:
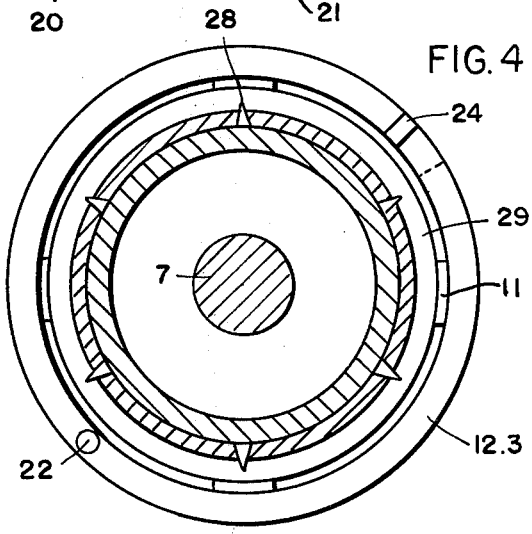

Between cylindrical cages 25.3 and 25.4 and between cage 25.4 and annular stop 23, thread severing zones 27.1 and 27.2 are located. In these severing zones cutting elements 28 are arranged, preferably axially mounted on spacing ring 29 and distributed uniformly about its circumference, concentric to the chuck. The cutting elements have a triangular cross-section, the form and arrangement of these elements within the hollow cylindrical cages being best illustrated in FIG. 4. As is shown in FIG. 3, spool sleeves 12.3 and 12.4 form a lip above and covering a portion of the severing zones. Thread-catching notch 24 is formed in this lip section of the sleeves.

When it is desired to change bobbins after the rotation of the bobbin revolver 3, the incoming thread is grasped by a thread guide (not shown in detail) and then is captured by the thread catching notchs 24 of the empty spool sleeves 12.3 and 12.4. Once this is accomplished, the thread is tensioned between the notch and the finished bobbins 17.1 and 17.2 which are still driven in the bobbin change position of the revolver 3 by the driver roller 2. As the thread is tensioned, it will be guided into the gap between the empty spool sleeves 12.3 and 12.4 and between sleeve 12.4 and stop 23 which contain the above-described thread severing zones. The above-mentioned length of the thread severing zones ensures that even with greatest possible over-dimension or under-dimension of empty sleeves 12.3 and 12.4, or of lug 22, the thread guided within these zones will fall onto the cutting elements 28 for positive severing.

While several particular embodiments of the present invention has been shown and described, it should be understood that various changes and modifications thereto may be made, and it is therefore intended in the following claims to include all such modifications and changes as may fall within the true spirit and scope of this invention.

What is claimed is:

1. An apparatus for winding continuous threads or yarns, said apparatus comprising:

a rotable chuck having a stop mounted thereon;

a removable spool sleeve slidably mounted on said chuck for thread take-up, a spacing lug on the end surface of said sleeve engaging said stop for spacing said end surface from said stop; and a means for cutting said thread located on said chuck in the space formed between said sleeve end surface and said stop.

2. The apparatus of claim 1 wherein said cutting means lie radially below the outer surface of said spool sleeve and preferably on a diameter smaller than the inner diameter of the spool sleeve.

3. The apparatus of claim 2 wherein said spool sleeve forms a lip which covers a portion of said cutting means, said lip having a thread-catching notch formed therein.

4. The apparatus of claim 3 wherein said cutting means comprise elements having a triangular cross-section with their cutting edge axially parallel to the axis of said chuck.

5. The apparatus of claim 4 wherein said cutting elements are axially mounted in a spacing ring which is concentric with said chuck.

6. The apparatus of claim 5 further comprising a second spool sleeve mounted on said chuck in axial alignment with said first mentioned sleeve and a second cutting means located on said chuck in the space formed between said sleeves.

7. The apparatus of claim 1 wherein said lug on the end surface of said sleeve is displaced with respect to said thread catching notch by an angle of from between 15° and 270°.

8. The apparatus of claim 7 wherein said lug projects beyond the end surface of said sleeve a distance of between 2 mm and 6 mm.

* * * * *